US009206708B2

(12) United States Patent
Moriyama et al.

(10) Patent No.: US 9,206,708 B2
(45) Date of Patent: Dec. 8, 2015

(54) DIRECT CONTACT CONDENSER FOR A STEAM TURBINE AND HAVING A FIRST COOLING WATER SPRAYING MECHANISM SPRAYING COOLING WATER DOWNSTREAM AND A SECOND COOLING WATER SPRAYING MECHANISM SPRAYING COOLING WATER IN MULTIPLE DIRECTIONS

(75) Inventors: Takashi Moriyama, Kawasaki (JP); Ryoji Muramoto, Kawasaki (JP); Yoshiki Oka, Kawasaki (JP)

(73) Assignee: Fuji Electric Co., Ltd., Kawasaki-shi, Kanagawa (JP)

( * ) Notice: Subject to any disclaimer, the term of this patent is extended or adjusted under 35 U.S.C. 154(b) by 0 days.

(21) Appl. No.: 13/818,806

(22) PCT Filed: Jul. 13, 2012

(86) PCT No.: PCT/JP2012/004545
§ 371 (c)(1),
(2), (4) Date: Feb. 25, 2013

(87) PCT Pub. No.: WO2013/008477
PCT Pub. Date: Jan. 17, 2013

(65) Prior Publication Data

US 2013/0152589 A1 Jun. 20, 2013

(30) Foreign Application Priority Data

Jul. 13, 2011 (JP) ..... 2011-154524

(51) Int. Cl.
*F01K 11/02* (2006.01)
*F01K 9/00* (2006.01)

(Continued)

(52) U.S. Cl.
CPC ..... *F01K 11/02* (2013.01); *F01K 9/003* (2013.01); *F01K 21/047* (2013.01); *F28B 3/04* (2013.01); *F28B 9/04* (2013.01)

(58) Field of Classification Search
CPC ..... F28B 3/04; F28B 3/08; F28B 3/0004; F28B 3/00; F28B 7/00; F01K 9/00–9/04; F01K 11/00–11/04
USPC ..... 60/654, 688; 165/60; 261/115, 116, 261/DIG. 10, DIG. 11, DIG. 76, DIG. 32, 261/DIG. 39; 95/288
See application file for complete search history.

(56) References Cited

U.S. PATENT DOCUMENTS 1,564,223 A * 12/1925 Ehrhart ..... F28B 3/04 261/70
3,834,133 A * 9/1974 Bow ..... B01D 1/16 165/112

(Continued)

FOREIGN PATENT DOCUMENTS

GB 917473 A * 2/1963 ..... F01K 9/00
JP 54-108802 U 7/1979

(Continued)

OTHER PUBLICATIONS (English translation) International Preliminary Report on Patentability for International Application No. PCT/JP2012/004545, dated Jan. 14, 2014.

(Continued)

*Primary Examiner* — Thomas Denion
*Assistant Examiner* — Laert Dounis
(74) *Attorney, Agent, or Firm* — Young Basile Hanlon & MacFarlane P.C.

(57) ABSTRACT

A steam turbine direct contact condenser prevents cooling water sprayed from spray nozzles from reaching turbine blades of an axial-flow turbine, while introducing turbine exhaust gases exhausted by a steam turbine in the horizontal direction to cool such gases. The condenser includes an exhaust gas inlet part that introduces the turbine exhaust gases containing steam of the steam turbine and non-condensable gases in the horizontal direction, a steam cooling chamber that sprays cooling water to the introduced turbine exhaust gases to cool them, and a water storage disposed at the bottom of the steam cooling chamber that stores condensed water cooled from the steam and the cooling water. The steam cooling chamber includes a first cooling water spraying mechanism and a second cooling water spraying mechanism.

9 Claims, 6 Drawing Sheets

(51) Int. Cl.

| | |
|---|---|
| ***F01K 21/04*** | (2006.01) |
| *F28B 3/04* | (2006.01) |
| *F28B 9/04* | (2006.01) |

(56) References Cited

U.S. PATENT DOCUMENTS

| | | | | |
|---|---|---|---|---|
| 5,925,291 | A * | 7/1999 | Bharathan et al. | 261/69.1 |
| 2010/0294468 | A1 | 11/2010 | Iwata et al. | |

FOREIGN PATENT DOCUMENTS

| | | | | |
|---|---|---|---|---|
| JP | 61-144371 | U | 9/1986 | |
| JP | 07019762 | A * | 1/1995 | |
| JP | 08121979 | A * | 5/1996 | F28B 3/04 |
| JP | 09-264675 | A | 10/1997 | |
| JP | 2001-193417 | A | 7/2001 | |
| JP | 2001193417 | A * | 7/2001 | |
| JP | 2007-023962 | A | 2/2007 | |
| JP | 2010-270925 | A | 12/2010 | |

OTHER PUBLICATIONS

Examination report issued by the Intellectual Property Office of New Zealand in corresponding New Zealand Application No. dated Oct. 24, 2014.

Office Action issued by the Intellectual Property Office of the Philippines in corresponding Philippines Application No. 1-2013-500352 dated Nov. 28, 2014.

* cited by examiner

DIRECT CONTACT CONDENSER FOR A STEAM TURBINE AND HAVING A FIRST COOLING WATER SPRAYING MECHANISM SPRAYING COOLING WATER DOWNSTREAM AND A SECOND COOLING WATER SPRAYING MECHANISM SPRAYING COOLING WATER IN MULTIPLE DIRECTIONS

TECHNICAL FIELD

The present invention relates to a direct contact condenser for a steam turbine which directly sprays cooling water to a turbine exhaust gas containing steam and non-condensable gases both exhausted from the steam turbine to cool and condense the steam turbine.

BACKGROUND

A direct contact condenser for an axial-flow exhaust turbine, which is one type of the direct contact condenser for a steam turbine, causes turbine exhaust gases exhausted from the axial-flow exhaust turbine to directly contact with cooling water, thereby condensing steam. Hence, it is important in performance how to increase the contact area of the cooling water in contact with the steam, and the cooling water is discharged and atomized to a space through a spray nozzle.

Moreover, it is important to optimize the layout of structural objects that disturb the flow path of the steam, and to minimize the pressure loss of the steam flow.

An example conventional condenser for an axial-flow exhaust turbine includes an exhaust duct that connects an open end of the steam turbine with the condenser, causes the exhaust exhausted from the steam turbine in a substantially horizontal direction to change a flow direction in the downward direction through the exhaust duct, and causes the exhaust to flow in the condenser from the upper space thereof. Moreover, a structure is known which has a distributer provided in the condenser in the flow direction of the exhaust and a spray water preventer in the exhaust duct (see, for example, JP 2007-023962 A).

As another known structure, there is a condenser that includes an inlet part that introduces turbine exhaust gases containing steam and non-condensable gases in a steam cooling chamber in a substantially horizontal direction, a plurality of first spray nozzles disposed in the steam cooling chamber and connected to a plurality of spray pipings in the introduced direction of the turbine exhaust gases, respectively, to spray cooling water to the turbine exhaust gases, and a water storage disposed at the bottom of the steam cooling chamber for storing condensed water condensed from the steam through the spraying of the cooling water (see, for example, JP 2010-270925 A).

BRIEF SUMMARY

According to the conventional example disclosed in JP 2007-023962 A, the turbine exhaust gases discharged by the axial-flow exhaust turbine in the horizontal direction are guided in the vertical direction through the exhaust duct, and are supplied to the condenser from the upper space thereof. Cooling water supply pipings are disposed in the downward flow direction of the turbine exhaust gases in the condenser, and the cooling water supply pipings are provided with respective nozzle bodies to spray the cooling water in the direction orthogonal to the flow direction of the turbine exhaust gases. At the uppermost nozzle body, a nozzle close to the axial-flow exhaust turbine has a flat fan-shaped splash zone, and nozzles having a circular cone-shaped splash zone are disposed in the other directions. Furthermore, the exhaust duct is provided with a spray water preventer. Accordingly, the nozzle close to the axial-flow exhaust turbine has a flat fan-shaped splash zone which prevents the spray water from splashing toward the axial-flow exhaust turbine, and the exhaust duct is provided with the spray water preventer, so that it is possible to prevent the turbine blade of the axial-flow exhaust turbine from colliding with the spray water and being damaged. There are, however, unsolved problems that a structure which avoids the spray water from colliding with the turbine blade of the axial-flow exhaust turbine becomes complex, and the flows of the turbine exhaust gases are disturbed since the spray water preventer is provided in the exhaust duct.

On the other hand, according to the prior art disclosed in JP 2010-270925 A, the turbine exhaust gases exhausted by the axial-flow exhaust turbine in the horizontal direction are introduced in the condenser disposed in the horizontal direction, and the plurality of spray pipings in the introduced direction of the turbine exhaust gas flow are connected with the plurality of first spray nozzles, thereby spraying the cooling water in the direction orthogonal to the introduced direction of the turbine exhaust gas flow. However, since no countermeasure for the reverse flow of the spray water is employed, there is an unsolved problem that part of the cooling water sprayed from the spray nozzles in the circular conical shape may reach the axial-flow exhaust turbine, and may damage the turbine blade.

Hence, the present invention has been made in view of the above-explained unsolved problems, and it is an object of the present invention to provide a direct contact condenser for a steam turbine which can surely prevent cooling water sprayed from spray nozzles from reaching the turbine blade of an axial-flow turbine, while introducing turbine exhaust gases exhausted by the steam turbine in the horizontal direction to cool such gases.

To accomplish the above object, there is provided a direct contact condenser for a steam turbine, the direct contact condenser comprising an exhaust gas inlet part configured to introduce a turbine exhaust gas containing steam and a non-condensable gas of the steam turbine in a horizontal direction, a steam cooling chamber configured to spray cooling water to the turbine exhaust gas introduced through the exhaust gas inlet part to cool the turbine exhaust gas, and a water storage which is disposed at a bottom of the steam cooling chamber and which stores condensed water cooled from the steam and the cooling water. The steam cooling chamber comprises a first cooling water spraying mechanism which is disposed at the exhaust gas inlet part side and which sprays the cooling water within a range restricted from a side to a downstream direction of the turbine exhaust gas and a second cooling water spraying mechanism which is disposed at a downstream side of the first cooling water spraying mechanism and which sprays the cooling water to the turbine exhaust gas in all directions.

According to the steam turbine direct contact condenser of a second aspect of the present invention, the first cooling water spraying mechanism may comprise a plurality of cooling water spray pipings extending in a direction orthogonal to a guiding direction of the turbine exhaust gas, in communication with a cooling water supply piping, and each formed with a plurality of spray nozzles in a lengthwise direction.

According to the steam turbine direct contact condenser of a third aspect of the present invention, the first cooling water spraying mechanism may comprise a coupling piping configured to couple the adjoining cooling water spray pipings in parallel with the turbine exhaust gas, in a flow path of the turbine exhaust gas, and a plurality of spray nozzles formed on a bottom side of the coupling piping.

According to the steam turbine direct contact condenser of a fourth aspect of the present invention, the plurality of spray nozzles formed on the coupling piping may spray the cooling water in at least either one of the downward direction and an obliquely downstream side.

According to the steam turbine direct contact condenser of a fifth aspect of the present invention, the second cooling water spraying mechanism may comprise a plurality of cooling water spray pipings extending in a direction orthogonal to a guided direction of the turbine exhaust gas, in communication with a cooling water supply piping, and each formed with a plurality of spray nozzles in a lengthwise direction.

According to a sixth aspect of the present invention, the steam turbine direct contact condenser may further comprise a gas cooling chamber which is formed at least either one of a downstream side and a side of the second cooling water spraying mechanism, and which causes a non-condensable gas remaining in the turbine exhaust gas to which the cooling water is sprayed to flow. The gas cooling chamber comprises a plurality of third cooling water spraying mechanisms which are formed in communication at either one of the downstream side and the side of the second cooling water spraying mechanism, and which spray the cooling water to the non-condensable gas remaining in the turbine exhaust gas.

According to a seventh aspect of the present invention, the steam turbine direct contact condenser may further comprise a partition plate having an opened bottom and disposed between the second cooling water spraying mechanism and the third cooling water spraying mechanisms.

According to the steam turbine direct contact condenser of an eighth aspect of the present invention, the water storage is provided with a connection port at a bottom of the water storage connected to a condensate pump, controls a water level between a normal operation water level where the connection port is completely below the water level and a maximum operation water level higher than the normal operation water level during a successive operation of the condensate pump, and has a water storage capacity set in such a way that the water level does not exceed an abnormal maximum water level lower than a bottom of the exhaust gas inlet part even if the water level exceeds the maximum operation water level due to a raise in the water level by remaining cooling water when the condensate pump abnormally stops.

According to the present invention, the turbine exhaust gases containing steam and non-condensable gases exhausted by the steam turbine in the horizontal direction are introduced into the steam cooling chamber in the horizontal direction through the exhaust gas inlet part. In the steam cooling chamber, there are provided the first cooling water spraying mechanism having the spray direction of the cooling water restricted within the spray range from a side to the downstream side of the turbine exhaust gases and the second cooling water spraying mechanism disposed at the downstream side of the first cooling water spraying mechanism and spraying the cooling water to the turbine exhaust gases in all directions. Accordingly, there is an advantage that can prevent the sprayed cooling water from reaching the steam turbine, while cooling the turbine exhaust gases in the original exhausted direction.

DETAILED DESCRIPTION

An explanation will be given of embodiments of the present invention with reference to the accompanying drawings.

Figure 1:
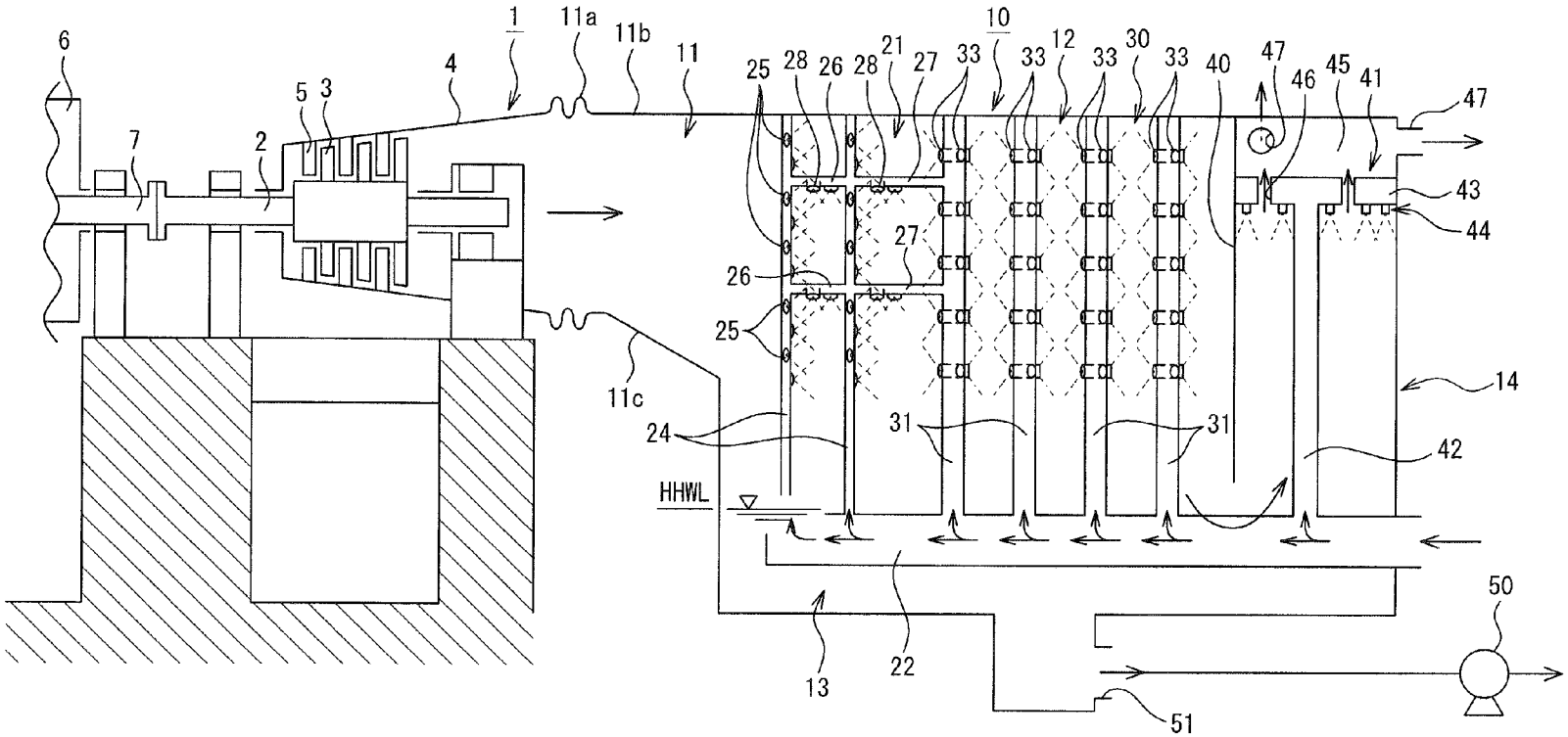
FIG. 1 is a cross-sectional view illustrating a direct contact condenser for a steam turbine according to a first embodiment of the present invention.
Figure 2:
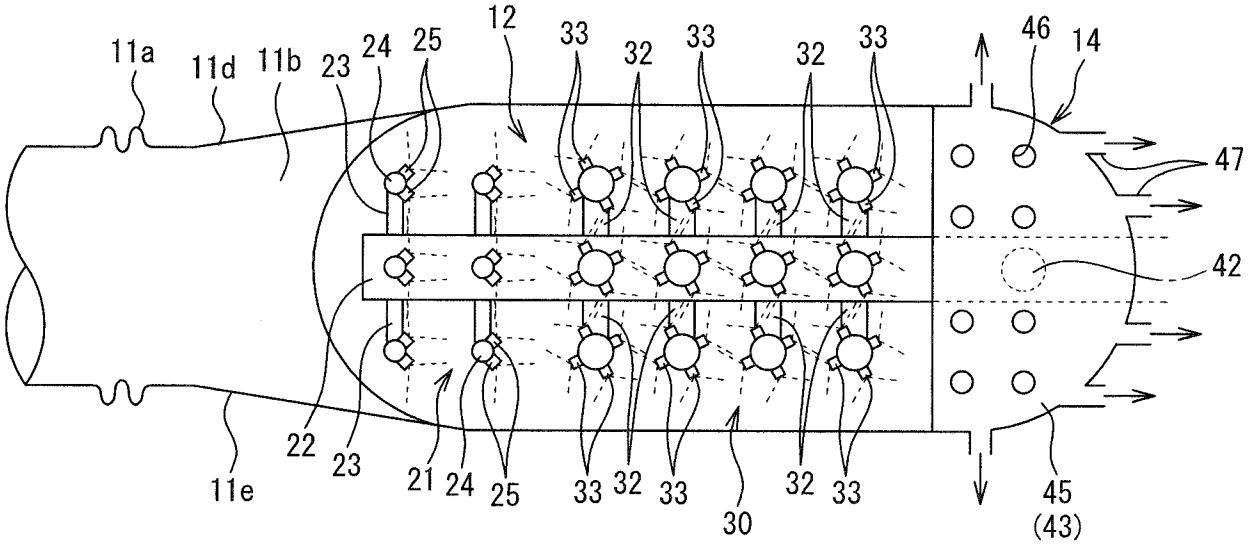
FIG. 2 is a plan view with a top panel removed from the condenser in FIG. 1.

FIG. 1 is a cross-sectional view illustrating a case in which a direct contact condenser for a steam turbine of the present invention is applied to an axial-flow exhaust steam turbine according to a first embodiment. FIG. 2 is a plan view with a top plate removed from the condenser.

In those figures, reference numeral 1 indicates an axial-flow exhaust steam turbine, and this axial-flow exhaust steam turbine 1 includes a plurality of rotor blades 3 fixed to a turbine shaft 2 held in a rotatable manner substantially horizontally, and a plurality of stator blades 5 provided in a casing 4 so as to face the respective rotor blades 3. A rotational shaft 7 of a power generator 6 is coupled with an end of the turbine shaft 2 protruding to the exterior of the casing 4.

Turbine exhaust gases containing steam and non-condensable gases exhausted by the axial-flow exhaust steam turbine 1 from the large-diameter end of the casing 4 in the horizontal direction are guided to a steam turbine direct contact condenser 10.

This steam turbine direct contact condenser 10 includes an exhaust gas inlet part 11 that introduces, in the horizontal direction, the turbine exhaust gases exhausted by the axial-flow exhaust steam turbine 1 from the casing 4 in the horizontal direction, a steam cooling chamber 12 which is disposed at the downstream side of the exhaust gas inlet part 11 and which sprays cooling water to the turbine exhaust gases introduced in the horizontal direction to cool such gases, a water storage 13 which is disposed at the bottom of the steam cooling chamber 12 and which stores condensed moisture cooled from the steam, and a gas cooling chamber 14 provided at the downstream side of the steam cooling chamber 12.

The exhaust gas inlet part 11 is coupled with the casing 4 of the axial-flow exhaust steam turbine 1 through a bellows 11*a*, and is formed in a relatively short duct shape in the axial direction which introduces the turbine exhaust gases in the horizontal direction by a horizontal top plate 11*b*, a right downward-sloping bottom plate 11*c*, and front plates 11*d* and 11*e* spreading in a tapered shape.

As illustrated in FIG. 1 and FIG. 2, the steam cooling chamber 12 includes a first cooling water spraying mechanism 21 disposed at the exhaust gas inlet part 11 side, and a second cooling water spraying mechanism 30 linked to the downstream side of the first cooling water spraying mechanism 21.

The first cooling water spraying mechanism 21 includes a water supply main piping 22, which is disposed at the center in the back-and-forth direction at the bottom side of the steam cooling chamber 12 and which supplies the cooling water, and a total of six spray pipings 24, which are three lines multiplied by two rows (when viewed in a planar view), coupled directly or via branched pipings 23 to the water supply main piping 22. The spray pipings 24 extend vertically in a direction orthogonal to the turbine exhaust gases guided in the horizontal direction.

Figure 3:
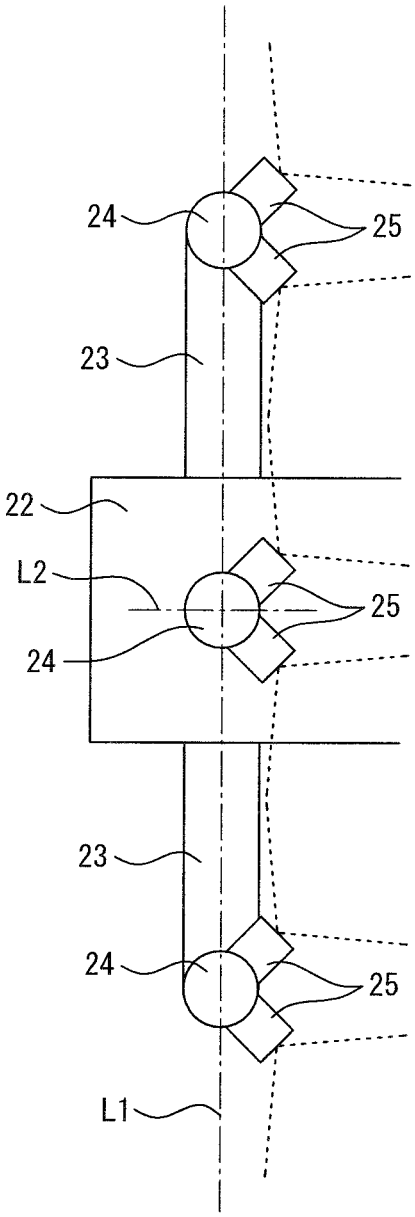
FIG. 3 is an enlarged plan view of a first cooling water spraying mechanism.

Each spray piping 24 is formed with five spray nozzles 25 at respective upper locations in contact with the turbine exhaust gases with a predetermined interval. As illustrated in FIG. 3, the spray nozzles 25 are attached on an outer circumferential surface that is a backward side relative to a back-and-forth horizontal line L1 passing through the center point of the spray piping 24 in such a way that the cooling water spraying direction becomes the downstream side. That is, the spray nozzles 25 are, for example, formed so as to extend on the lines at ±45 degrees in the radial direction across a horizontal line L2 orthogonal to the back-and-forth direction horizontal line L1 at the center points of the spray pipings 24. The spray nozzles 25 spray the cooling water in a spray zone of a circular conical shape at a wide angle of, for example, 100 degrees. Hence, the direction of the sprayed cooling water is restricted within a range from the side of the spray piping 24 to the flow direction of the turbine exhaust gases, and no cooling water is sprayed in the direction toward the rotor blades 3 of the steam turbine 1. The attachment angle of the spray nozzles 25 and the angle of the sprayed cooling water are not limited to the above explained examples, and the attachment angle and the angle of the sprayed cooling water can be set arbitrary as long as no cooling water is sprayed toward the turbine 1.

Moreover, as illustrated in FIG. 1, the respective spray pipings 24 adjoining to each other in the flow direction of the turbine exhaust gases are coupled together through a coupling piping 26 at an area where no spray nozzle 25 is formed. Likewise, the spray piping 24 at the outermost downstream side is coupled with a spray piping 31 of the second cooling water spraying mechanism 30 facing that spray piping 24 through a coupling piping 27. Furthermore, spray nozzles 28 that spray the cooling water downward or to the obliquely downstream side are formed at the lower faces of the respective coupling pipings 26 and 27.

As illustrated in FIG. 2, the second cooling water spraying mechanism 30 includes a total of twelve (12) spray pipings 31, which are provided at respective intersections of a matrix of four rows maintaining a predetermined interval in the flow direction of the turbine exhaust gases when viewed in a planar view, and three lines in the back-and-forth direction, and which intersect with the flow direction of the turbine exhaust gases so as to extend in the vertical direction. The spray piping 31 of each row is directly coupled with the water supply main piping 22 or through a branched piping 32, and the cooling water is supplied to the spray piping 31. The spray nozzles 33 are formed on five levels in each of the spray pipings 31 at the upper portion side in contact with the turbine exhaust gases with a predetermined interval. As illustrated in FIG. 2, four spray nozzles 33 are formed in the circumferential direction of each spray piping 31 at an interval of 90 degrees. Moreover, a spray zone of a circular conical shape is formed from each spray nozzle 33 at a wide angle of, for example, 100 degrees, and each spray nozzle 33 sprays the cooling water within this spray zone. Hence, the cooling water can be sprayed in all directions around the spray piping 31. In this case, also, the attachment angle of the spray nozzle 33 and the spray angle can be set arbitrary.

The gas cooling chamber 14 is partitioned by a partition plate 40 having a bottom opened and in communication with the steam cooling chamber 12. A third cooling water spraying mechanism 41 sprays the cooling water to the turbine exhaust gases (remaining non-condensable gases and accompanying steam) introduced through the partition plate 40 from the upper space.

As illustrated in FIG. 1, the third cooling water spraying mechanism 41 has a coupling piping 42, which is placed at the center so as to be coupled with the water supply main piping 22 and which extends in the vertical direction. A cooling water reservoir 43 is in communication with the upper end of the coupling piping 42. The cooling water reservoir 43 is provided with spray nozzles 44, which are formed on the bottom face of the cooling water reservoir 43 at a predetermined interval and which spray the cooling water to the lower space. Moreover, the cooling water reservoir 43 is formed with openings 46, which are disposed at respective locations where no spray nozzle 44 is present and which allow the turbine exhaust gases to pass through to a gas exhaust part 45 above the cooling water reservoir 43. The gas exhaust part 45 is formed with exhaust ports 47 that exhaust the turbine exhaust gases in the back-and-forth direction and in the right direction.

Furthermore, the water storage 13 is formed so as to sag downward below the steam cooling chamber 12 and the gas cooling chamber 14, and a connection port 51 connected with a condensate pump 50 at the exterior is formed at the center part of the bottom of the water storage. The water storage 13 controls the water level so as to be located between a normal operation water level where the connection port 51 is completely below the water level and a maximum operation water level (HHML) higher than the normal operation water level, while the condensate pump 50 is successively operating.

A water storing volume is set in such a way that the water level does not exceed an abnormal maximum water level lower than the bottom of the exhaust gas inlet part 11 even if the water level exceeds the maximum operation water level due to the raised water level by the cooling water passing through during a closing time of, for example, changing the state of a cooling water supply valve (not shown) provided in the water supply main piping 22 to a closed state and remaining in the water supply main piping 22, the branched pipings 23, the spray pipings 24, the coupling pipings 26 and 27, the spray pipings 31, the coupling piping 42 all subsequent to the cooling water supply valve and in the cooling water reservoir 43 when the condensate pump 50 is abnormally stopped due to a blackout or a breakdown, etc.

Next, an explanation will be given of an operation according to the first embodiment.

When both axial-flow exhaust steam turbine 1 and steam turbine direct contact condenser 10 are in the operating state, the turbine exhaust gases containing the steam exhausted by the axial-flow exhaust steam turbine 1 from the casing 4 in the horizontal direction and the non-condensable gases are introduced in the steam turbine direct contact condenser 10. In the steam turbine direct contact condenser 10, the turbine exhaust gases are introduced through the exhaust gas inlet part 11, while maintaining the flow direction in the horizontal direction, and the turbine exhaust gases are supplied to the steam cooling chamber 12 at the downstream side.

The first cooling water spraying mechanism 21 is disposed at the exhaust gas inlet part 11 side in the steam cooling chamber 12. The first cooling water spraying mechanism 21 has spray nozzles 25 formed at respective back sides of the spray pipings 24 which traverse the turbine exhaust gases and extend in the vertical direction. Hence, the spray zone of the cooling water sprayed from each spray nozzle 25 is restricted to a spray area, which is arranged behind the horizontal line L1 interconnecting the center points of the front and back spray pipings 24 and is arranged at the downstream side of the turbine exhaust gases from respective sides of the spray pipings 24.

Accordingly, no cooling water sprayed from the spray nozzle 25 is directed to the rotor blades 3 of the axial-flow exhaust steam turbine 1, and it is unnecessary to provide an additional mechanism that suppresses a reverse flow of the sprayed cooling water. Hence, the turbine exhaust gases exhausted by the axial-flow exhaust steam turbine 1 can be smoothly introduced into the first cooling water spraying mechanism 21 with little piping resistance.

At this time, it is unnecessary that the spray direction of the cooling water sprayed from the spray nozzles 25 is strictly limited to a direction from the direction orthogonal to the flow direction of the turbine exhaust gases to the downstream side. Since the cooling water is pushed back by the force of the flowing turbine exhaust gases, the cooling water may be sprayed slightly toward the upstream side.

The cooling water sprayed from the first cooling water spraying mechanism 21 causes part of steam in the turbine exhaust gases to be cooled and to become condensed water, and the condensed water is stored in the water storage 13. In the first cooling water spraying mechanism 21, since the coupling pipings 26 and 27 are also provided with spray nozzles 28 in addition to the spray pipings 24 disposed in the vertical direction, the cooling efficiency of the turbine exhaust gases can be improved by the cooling that corresponds to the spray nozzles 28. Moreover, since the spray direction of the cooling water sprayed from the spray nozzles 28 is set to an obliquely downward direction, it becomes possible to surely suppress a reverse flow of the cooling water to the axial-flow exhaust steam turbine 1.

The turbine exhaust gases that have passed through the first cooling water spraying mechanism 21 enter the second cooling water spraying mechanism 30, and the cooling water is sprayed from the five levels of spray nozzles 33 provided on the twelve (12) spray pipings 31 in all directions around each spray piping 31. Accordingly, the steam left in the turbine exhaust gases is cooled and most of the cooled steam becomes condensed water stored in the water storage 13.

Most of the steam is eliminated as condensed water in the second cooling water spraying mechanism 30, and thus the remaining non-condensable gases and accompanying steam in the turbine exhaust gases are introduced in the gas cooling chamber 14 through the opening at the bottom of the partition plate 40. Since the cooling water is sprayed from the spray nozzles 44 formed on the bottom face of the cooling water reservoir 43 formed above the gas cooling chamber 14, the non-condensable gases are cooled, guided to the gas exhaust part 45 through the openings 46 formed in the cooling water reservoir 43, and exhausted to the exterior through the respective exhaust ports 47.

On the other hand, the water level of the condensed water and the cooling water stored in the water storage 13 is controlled between the normal operation water level, where the connection port 51 of the condensate pump 50 becomes completely below the water level, and the maximum operation water level, which is higher than the normal operation water level, through successive operation of the condensate pump 50.

In this state, when the condensate pump 50 abnormally stops due to a blackout or a breakdown, etc., the cooling water supply valve (not illustrated) provided in the water supply main piping 22 is automatically closed. However, the cooling water supplied during the closing time until the cooling water supply valve is fully closed, and the remaining cooling water in the water supply main piping 22, the branched pipings 23, the spray pipings 24, the coupling pipings 26 and 27, the spray pipings 31, the coupling piping 42, and the cooling water reservoir 43 all subsequent to the cooling water supply valve, are stored in the water storage 13.

At this time, the water storage capacity of the water storage 13 is set in such a way that the abnormal maximum water level does not reach the bottom of the exhaust gas inlet part 11 even if the water storage capacity of the water storage 13 absorbs the increased amount of the cooling water when the condensate pump 50 is stopped. Accordingly, it becomes possible to surely suppress a reverse flow of the cooling water to the axial-flow exhaust steam turbine 1.

Next, an explanation will be given of a second embodiment of the present invention with reference to FIG. 4 and FIG. 5.

According to the second embodiment, the gas cooling chamber 14 is provided at the side faces of the steam cooling chamber 12 instead of a case in which the gas cooling chamber is provided at the downstream side in the flow direction of the turbine exhaust gases of the steam cooling chamber 12.

Figure 4:
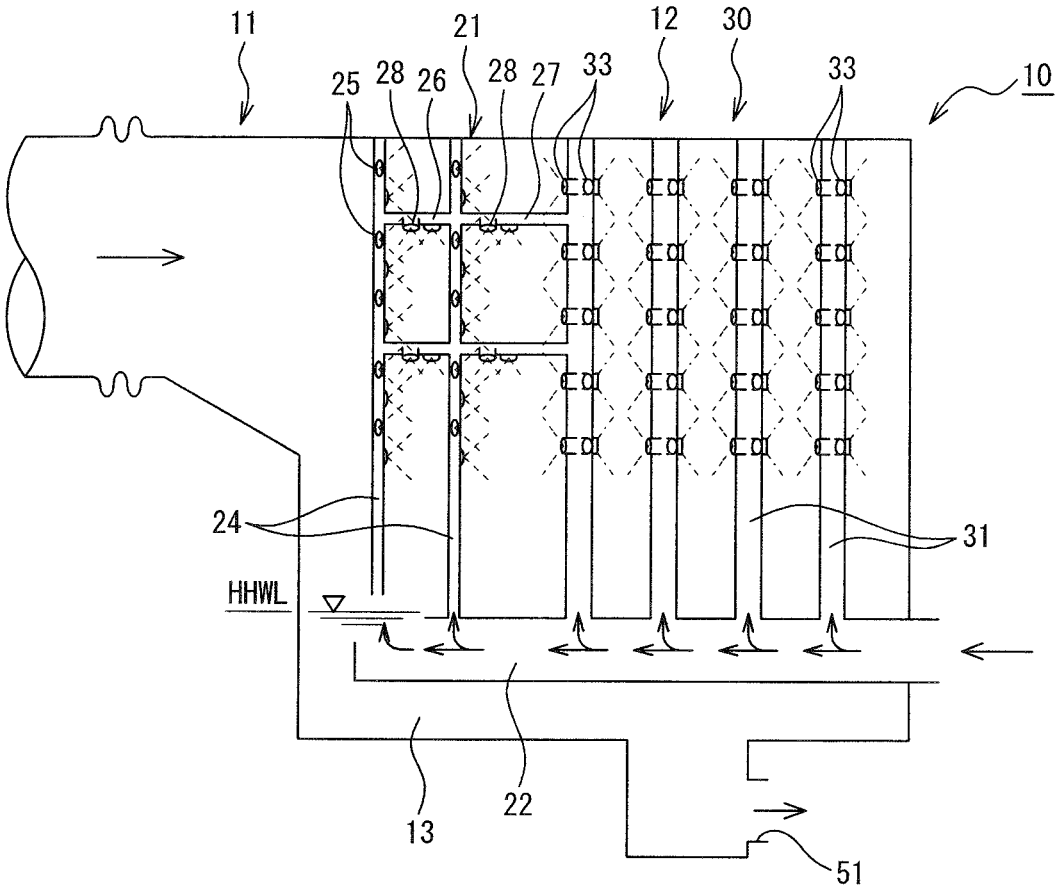
FIG. 4 is a cross-sectional view illustrating a direct contact condenser for a steam turbine according to a second embodiment of the present invention.
Figure 5:
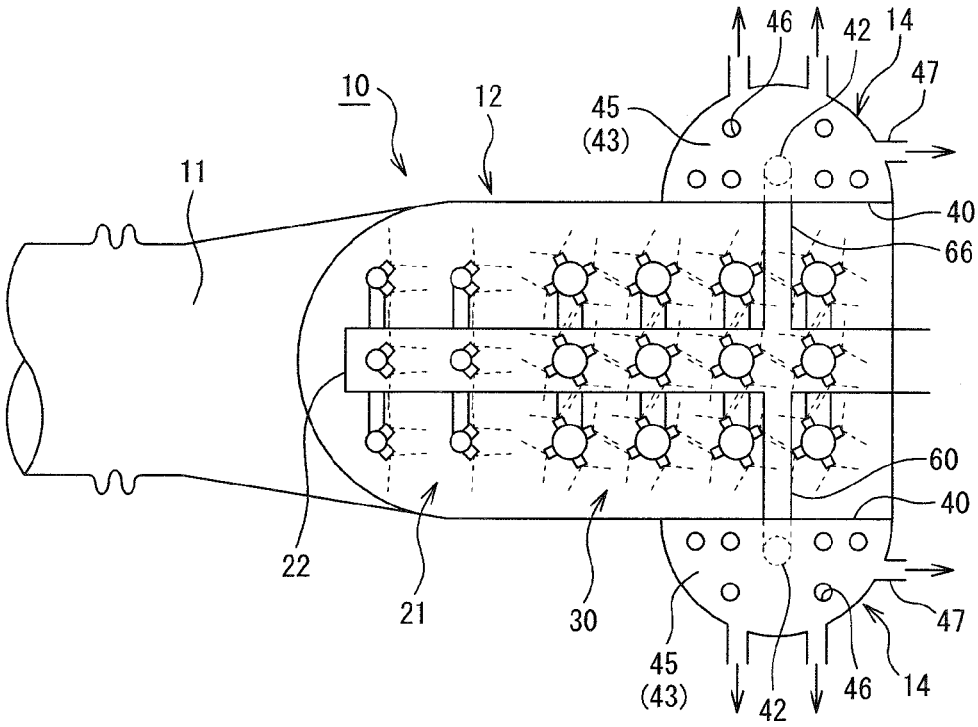
FIG. 5 is a plan view with a top panel removed from the condenser in FIG. 4.

That is, according to the second embodiment, as illustrated in FIG. 4 and FIG. 5, an end of the second cooling water spraying mechanism 30 in the steam cooling chamber 12 in the flow direction of the turbine exhaust gases is blocked off. Instead of this structure, the gas cooling chambers 14 are in communication with both back and forth side faces facing the spray pipings 31 of the two rows at the right end of the second cooling water spraying mechanism 30 through the partition plate 40. The other structures are the same as those of the first embodiment. The cooling water is supplied to the front and rear gas cooling chambers 14 from the water supply main piping 22 through branched pipings 60.

Also in the second embodiment, most of the steam contained in the turbine exhaust gases is cooled by the cooling water sprayed from the spray nozzles 33 of the second cooling water spraying mechanism 30 in the steam cooling chamber 12 in all directions, becomes condensed water, and is stored in the water storage 13. The steam is eliminated through the second cooling water spraying mechanism 30, and the remaining non-condensable gases and associated steam are cooled in the front and rear gas cooling chambers 14 at both sides, and are exhausted to the exterior through the gas exhaust part 45. Also in the second embodiment, the same advantages and effects as those of the first embodiment are achievable.

In the first and second embodiments, the explanations have been given of the case in which the turbine exhaust gases having the steam exhausted from the steam cooling chamber 12 and eliminated are introduced into the gas cooling chamber 14 to cool the turbine exhaust gases. The present invention is, however, not limited to this case. When the turbine exhaust gases cooled by the second cooling water spraying mechanism 30 has a low temperature, the gas cooling chamber 14 can be eliminated.

Figure 6:
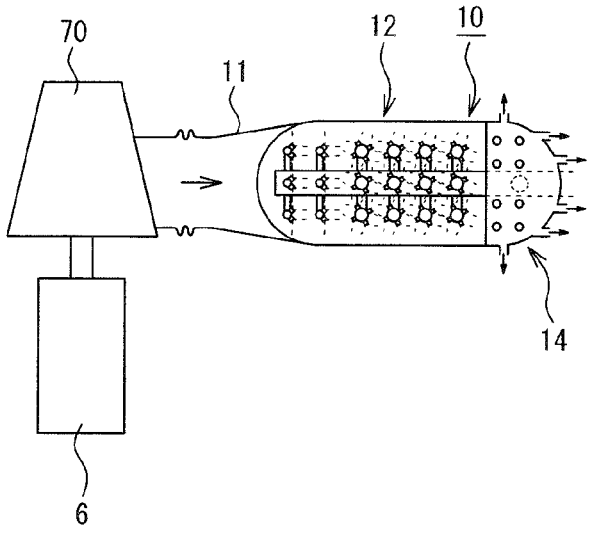
FIG. 6 is a plan view illustrating a case in which the steam turbine direct contact condenser of the present invention is applied to a side exhaust steam turbine.
Figure 7:
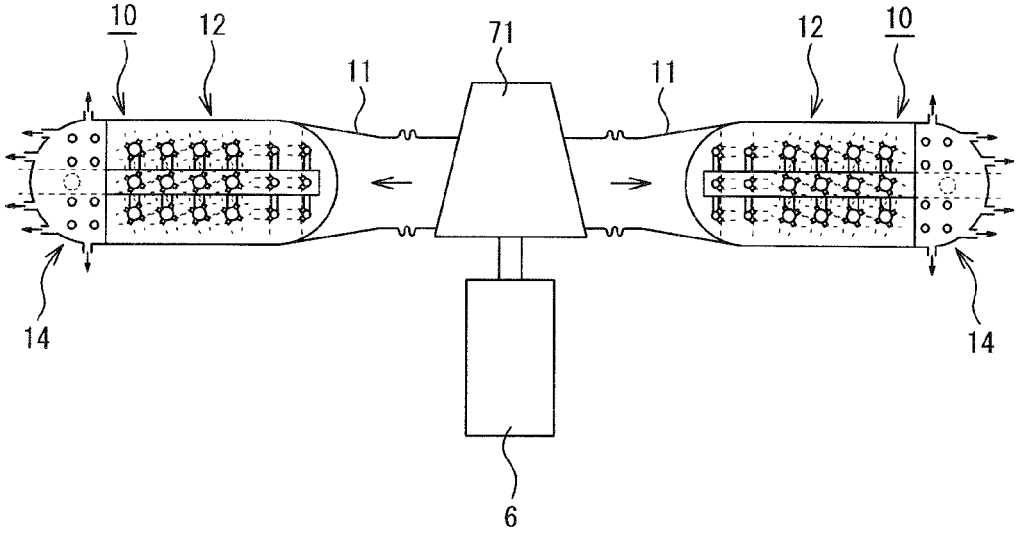
FIG. 7 is a plan view illustrating a case in which the steam turbine direct contact condenser according to the present invention is applied to a both-side exhaust steam turbine.

Moreover, in the first and second embodiments, although the explanations have been given of the case in which the steam turbine direct contact condenser 10 of the present invention is applied to the axial-flow exhaust steam turbine 1, the present invention is not limited to this case. That is, as illustrated in FIG. 6, the steam turbine direct contact condenser 10 of the present invention can be applied to a side exhaust steam turbine 70. As illustrated in FIG. 7, the steam turbine direct contact condenser 10 of the present invention can be applied to each of both sides of both-side exhaust steam turbine 71.

According to the present invention, there is provided a direct contact condenser for a steam turbine which can surely prevent cooling water sprayed from spray nozzles from reaching the turbine blade of an axial-flow turbine, while introducing the turbine exhaust gases exhausted by the steam turbine into the horizontal direction to cool such gases.

The invention claimed is:

1. A direct contact condenser for a steam turbine, the direct contact condenser comprising:

an exhaust gas inlet part configured to introduce a turbine exhaust gas containing steam and a non-condensable gas of the steam turbine in a horizontal direction;

a steam cooling chamber configured to spray cooling water at the turbine exhaust gas introduced through the exhaust gas inlet part to cool the turbine exhaust gas; and a water storage which is disposed at a bottom of the steam cooling chamber and which stores condensed water generated by cooling the steam and the cooling water, the steam cooling chamber comprising:

a first cooling water spraying mechanism which is disposed adjacent the exhaust gas inlet part and which sprays the cooling water within a range restricted to a downstream direction of the turbine exhaust gas; and a second cooling water spraying mechanism which sprays the cooling water to the turbine exhaust gas cooled by the first cooling water spraying mechanism in all directions.

2. The steam turbine direct contact condenser according to claim 1, wherein the first cooling water spraying mechanism comprises a plurality of cooling water spray pipings extending in a direction orthogonal to a guiding direction of the turbine exhaust gas, in communication with a cooling water supply piping, and each formed with a plurality of spray nozzles in a lengthwise direction.

3. The steam turbine direct contact condenser according to claim 2, wherein the first cooling water spraying mechanism comprises:

a coupling piping configured to couple adjoining cooling water spray pipings of the plurality of cooling water spray pipings in parallel with the turbine exhaust gas in a flow path of the turbine exhaust gas; and a plurality of spray nozzles formed on a bottom side of the coupling piping.

4. The steam turbine direct contact condenser according to claim 3, wherein the plurality of spray nozzles spray the cooling water in at least one of a downward direction or an obliquely downstream side.

5. The steam turbine direct contact condenser according to claim 1, wherein the second cooling water spraying mechanism comprises a plurality of cooling water spray pipings extending in a direction orthogonal to a guided direction of the turbine exhaust gas, in communication with a cooling water supply piping, and each formed with a plurality of spray nozzles in a lengthwise direction.

6. The steam turbine direct contact condenser according to claim 1, further comprising:

a gas cooling chamber which is formed at least either one of a downstream side or a side of the second cooling water spraying mechanism, and which causes a non-condensable gas remaining in the turbine exhaust gas to which the cooling water is sprayed to flow, and wherein the gas cooling chamber comprises a plurality of third cooling water spraying mechanisms which are formed in communication at either one of the downstream side or the side of the second cooling water spraying mechanism, and which spray the cooling water to the noncondensable gas remaining in the turbine exhaust gas.

7. The steam turbine direct contact condenser according to claim 6, further comprising:

a partition plate having an opened bottom and disposed between the second cooling water spraying mechanism and the plurality of third cooling water spraying mechanisms.

8. The steam turbine direct contact condenser according to claim 1, wherein the water storage is provided with a connection port at a bottom of the water storage connected to a condensate pump, controls a water level between a normal operation water level where the connection port is completely below the water level and a maximum operation water level higher than the normal operation water level during a successive operation of the condensate pump, and has a water storage capacity set in such a way that the water level does not exceed an abnormal maximum water level lower than a bottom of the exhaust gas inlet part even if the water level exceeds the maximum operation water level due to a raise in the water level by remaining cooling water when the condensate pump abnormally stops.

9. A direct contact condenser for a steam turbine, the direct contact condenser comprising:

an exhaust gas inlet part configured to introduce a turbine exhaust gas containing steam and a non-condensable gas of the steam turbine in a horizontal direction;

a steam cooling chamber configured to spray cooling water at the turbine exhaust gas introduced through the exhaust gas inlet part to cool the turbine exhaust gas; and a water storage which is disposed at a bottom of the steam cooling chamber and which stores condensed water generated by cooling the steam and the cooling water, the steam cooling chamber comprising:

a first cooling water spraying mechanism comprising at least one water spray piping, which extends at least in part in a direction orthogonal to a guiding direction of the turbine exhaust gas, which is disposed adjacent the exhaust gas inlet part and which sprays the cooling water within a range restricted to a downstream direction of the turbine exhaust gas; and a second cooling water spraying mechanism comprising at least one water spray piping, which extends at least in part in a direction orthogonal to a guiding direction of the turbine exhaust gas and which sprays the cooling water to the turbine exhaust gas cooled by the first cooling water spraying mechanism in all directions.

* * * * *